US007392780B2

(12) United States Patent
Tsuruta et al.

(10) Patent No.: US 7,392,780 B2
(45) Date of Patent: Jul. 1, 2008

(54) MACHINE PROVIDED WITH PULSATING OIL PRESSURE REDUCING DEVICE

(75) Inventors: Tatsunori Tsuruta, Saitama (JP); Noriaki Kawai, Saitama (JP); Chihiro Nishikawa, Saitama (JP); Nobuharu Takahashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/717,176

(22) Filed: Mar. 13, 2007

(65) Prior Publication Data

US 2007/0227476 A1 Oct. 4, 2007

(30) Foreign Application Priority Data

Mar. 29, 2006 (JP) ..... 2006-092003

(51) Int. Cl.
*F01M 1/16* (2006.01)
*F01M 1/04* (2006.01)

(52) U.S. Cl. ..... 123/196 CP

(58) Field of Classification Search ..... 123/196 R, 123/196 CP, 196 M, 41.86, 572
See application file for complete search history.

(56) References Cited

U.S. PATENT DOCUMENTS

2007/0224053 A1* 9/2007 Kondo et al. ..... 417/312

FOREIGN PATENT DOCUMENTS

JP 2005-146995 6/2005
JP 2005-146998 * 6/2005

* cited by examiner

*Primary Examiner*—Hai H Huynh
(74) *Attorney, Agent, or Firm*—Arent Fox LLP

(57) ABSTRACT

A pulsating oil pressure reducing device 40 for an internal combustion engine has an oil chamber 41 for reducing pulsating oil pressure in a discharge passage 30 for carrying oil discharged from an oil pump 20. The oil chamber 41 communicates with the discharge passage 30 by way of a connecting port 41*a*1 and makes the oil stagnate therein. The oil chamber 41 is connected to the discharge passage 30 by an air vent passage 45 through which air is discharged from the oil chamber 41 into the discharge passage 30. The air vent passage 45 has an inlet port 45*a* opening into a top part 41*a* of the oil chamber 41 and a discharge port 45*b* opening into the oil passage 30 at a level above the inlet port 45*a*. Since the pulsating oil pressure reducing device 40 having the air vent passage separately from the connecting port, air can be efficiently discharged from the oil chamber and the degree of freedom of placement of the oil passage and the oil chamber is increased.

9 Claims, 7 Drawing Sheets

MACHINE PROVIDED WITH PULSATING OIL PRESSURE REDUCING DEVICE

BACKGROUND OF THE INVENTION

1. Technical Field

The present invention relates to a machine provided with a pulsating oil pressure reducing device for reducing the pulsating oil pressure in an oil passage, such as an internal combustion engine provided with an oil pump.

2. Description of the Related Art

In a positive-displacement oil pump, the volume of an enclose space is increased to suck an oil into the enclosed space and is decreased to discharge the oil from the enclosed space. Therefore, both oil pressure in the suction passage connected to the inlet port of the positive-displacement oil pump and oil pressure in the discharge passage connected to the outlet port of the positive-displacement oil pump pulsate. The pulsating oil pressure causes undesirable phenomena including vibration and noise generation. For example, the pulsating oil pressure vibrates an oil filter placed in the discharge passage and causes the oil filter to generate noise. The pulsating oil pressure in the suction passage propagated to the oil contained in an oil pan vibrates the oil pan and causes the oil pan to generate noise. A technique disclosed in, for example, JP-A 2005-146995 forms an oil chamber in a branch passage branched from an oil passage to reduce pulsating oil pressure.

Air leaks through small gaps into oil passages and the oil pump while the oil pump is not operating. Therefore, the oil contains a comparatively large amount of air at an initial stage of operation after the oil pump has been started. If the air contained in the oil accumulates excessively in the oil chamber, the pulsative pressure suppressing effect of the oil chamber is reduced. Excessive accumulation of air in the oil chamber can be avoided by connecting ports formed in upper parts of the oil chamber to the oil passage.

The ports formed in the upper parts of the oil chamber need to be opened into the oil passage to discharge air from the oil chamber into the oil passage. Such a requisite condition places restrictions on the position of the oil chamber relative to the oil passage and on the placement of the oil chamber and, consequently, the degree of freedom of placing the oil chamber decreases.

In a machine provided with oil passages, such as an internal combustion engine, the arrangement of the oil passages is dependent on the construction of the machine and the arrangement of an oil pump and an oil filter. If an oil passage and an oil chamber are arranged horizontally in side-by-side relation, it is difficult to discharge air efficiently through a discharge port formed in the upper part of the oil chamber into the oil passage.

SUMMARY OF THE INVENTION

The present invention has been made in view of such a problem and it is therefore an object of the present invention to provide a machine with a pulsating oil pressure reducing device including an oil chamber provided with an air vent port in addition to a connecting port and capable of discharging air efficiently from an oil chamber into an oil passage and of increasing the degree of freedom of placing the oil passage and the oil chamber. Another object of the present invention is to facilitate building a pulsating oil pressure reducing device, to improve the adaptability of a pulsating oil pressure reducing device to the variable placement of a machine, and to reduce the cost of a pulsating oil pressure reducing device.

The present invention provides a machine provided with a pulsating oil pressure reducing device, for reducing pulsating oil pressure in an oil passage, including an oil chamber communicating with the oil passage by way of a connecting port in a manner to make oil stagnate in the oil chamber; wherein the oil chamber is connected to the oil passage by an air vent passage through which air is discharged from the oil chamber into the oil passage, the air vent passage is provided separately from the connecting port and has an inlet port opening into a top part of the oil chamber and an outlet port opening into the oil passage at a level above the inlet port.

According to the present invention, the air vent passage opens into the oil passage at a position at a level above the inlet port opening into a top part of the oil chamber in which air is likely to accumulate. Therefore, air accumulated in the oil chamber can be efficiently discharged into the oil passage and hence pulsating oil pressure can be effectively reduced. The oil chamber of the pulsating oil pressure reducing device is provided with the connecting port and the air vent passage separately from the connecting port. Therefore, the placement of the oil chamber is not restricted by the position of the connecting port. Since the air vent passage needs to meet only a condition requiring opening the outlet port of the air vent passage into the oil passage at a position at a level above the inlet port of the air vent passage, the oil passage and the oil chamber do not need necessarily to be vertically arranged, and air can be efficiently discharged from the oil chamber into the oil passage even if the oil passage and the oil chamber are horizontally arranged. Thus the pulsating oil pressure reducing device provides a large degree of freedom of placing the oil passage and the oil chamber.

Typically, the oil passage and the oil chamber of the present invention are horizontally arranged in side-by-side relation.

Thus air accumulated in the oil chamber can be efficiently discharged into the oil passage and hence the pulsating oil pressure can be effectively reduced even if the construction of the machine requires the horizontal side-by side arrangement of the oil passage and the oil chamber.

Desirably, the oil passage and the oil chamber extend horizontally.

When the horizontally elongate oil passage and the horizontally elongate oil chamber are disposed vertically close to each other, air accumulated in the oil chamber, in which air can more easily accumulate than in a vertically elongate oil chamber, can be efficiently discharged through the air vent passage and pulsating oil pressure can be effectively reduced.

Typically, the air vent passage has an upper ceiling surface sloping upward from the oil chamber toward the oil passage.

Since the upper side surface of the air vent passage slopes upward from the oil chamber toward the oil passage, air accumulated in the oil chamber can easily flow toward the oil passage and hence air can be efficiently discharged from the oil chamber.

Preferably, the oil passage and the pulsating oil pressure reducing device are formed in a structure dividable along a parting line in to an upper member and a lower member, the oil passage is defined by both the upper and the lower member, the oil chamber is formed only in the lower member, and the air vent passage is formed only in the upper member.

When the oil passage is defined by both the upper and the lower member, and the oil chamber is formed only in the lower member, the air vent passage having its inlet port formed in the top ceiling surface of the oil chamber and the outlet port opening into the oil passage can be easily formed. Since the connecting port is formed in the lower member, air discharged through the air vent passage cannot easily return through the connecting port into the oil chamber. Since the air vent passage is formed in the upper member, change in the inclination of the machine to a horizontal plane and resulting change in the position of a space in which air accumulates can be dealt with without changing the lower member and by replacing the upper member with another upper member provided with an air vent passage suitable for the inclination of machine. Thus the pulsating oil pressure reducing device has high applicability to various positions of the machine and can reduce the cost of the internal combustion engine.

Preferably, the oil chamber has a groove formed in the lower member and is a cavity having an expanded part in a depth thereof remote from the connecting port opening into the oil passage.

The inlet port of the air vent passage may be positioned nearer to the connecting port than the expanded part of the oil chamber.

The air vent passage may be a narrow groove formed in the upper member.

The oil passage may have an upstream end connected to an oil pump, and the outlet port of the air vent passage may be nearer to the oil pump than the connecting port.

DESCRIPTION OF THE PREFERRED EMBODIMENTS

An internal combustion engine E in a preferred embodiment of the present invention will be described with reference to the accompanying drawings.

Figure 1:
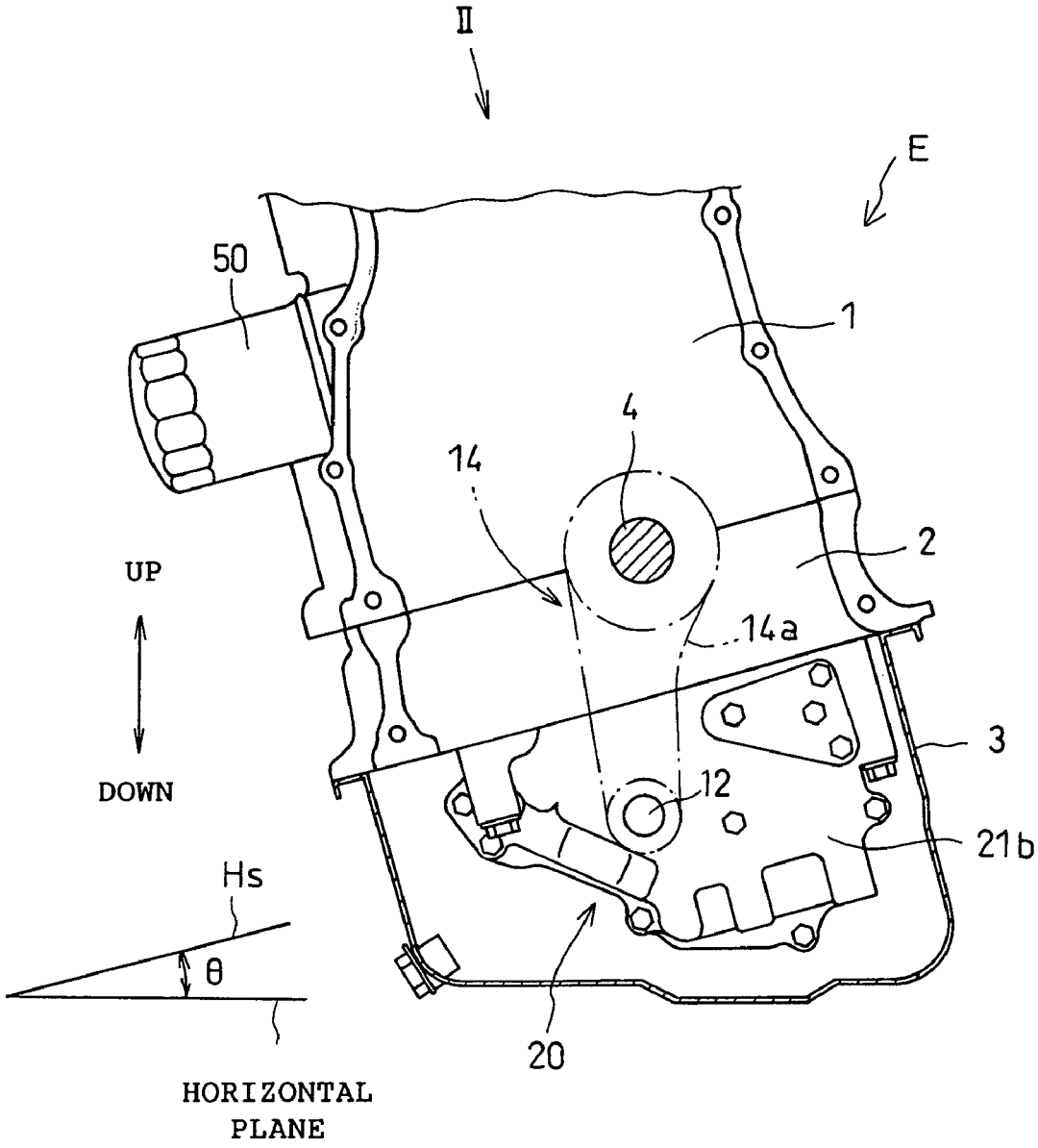
FIG. 1 is a fragmentary view, partly in section, of an internal combustion engine to which the present invention is applied.

Referring to FIG. 1, the internal combustion engine E is an in-line 4-cylinder 4-stroke internal combustion engine mounted on a transverse-engine vehicle with its crankshaft 4 extending transversely. The internal combustion engine E has an engine body including a cylinder block 1 provided with four cylinders and four pistons axially slidably fitted in the cylinders, respectively, for reciprocation, a lower block 2 joined to the lower end surface of the cylinder block 1, and an oil pan 3 joined to the lower end surface of the lower block 2. Pistons driven by the pressure of a combustion gas produced by the combustion of an air-fuel mixture in combustion chambers drive the crankshaft 4 rotatably supported on the cylinder block 1 and the lower block 2 for rotation. The engine body is mounted on the body of the vehicle with a plane Hs perpendicular to a plane including the axes of the cylinders inclined at a predetermined angle θ of, for example, 15° to a horizontal plane.

Figure 2:
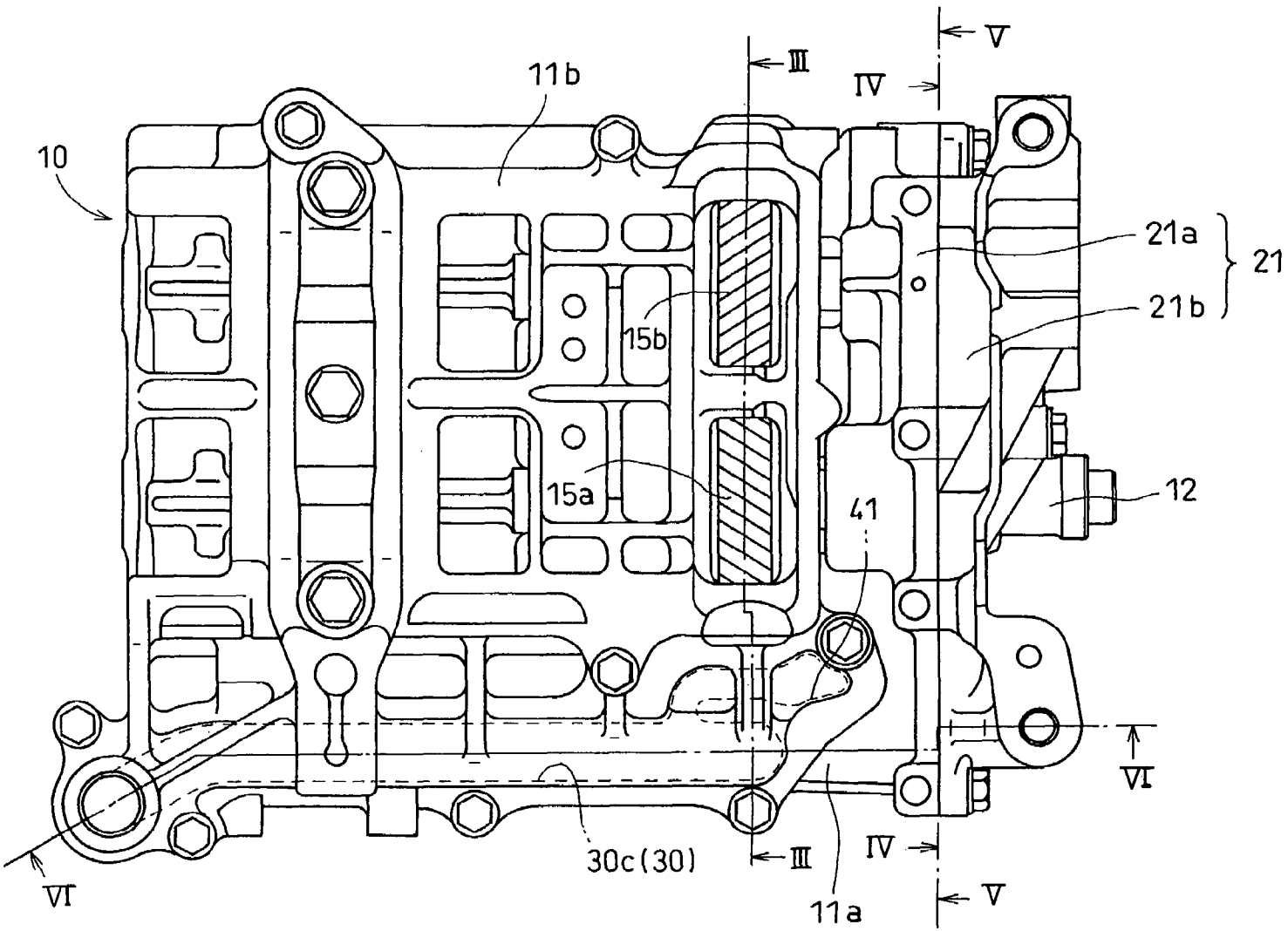
FIG. 2 is a view of a balancer and an oil pump included in the internal combustion engine shown in FIG. 1, taken in the direction of the arrow II in FIG. 1.
Figure 3:
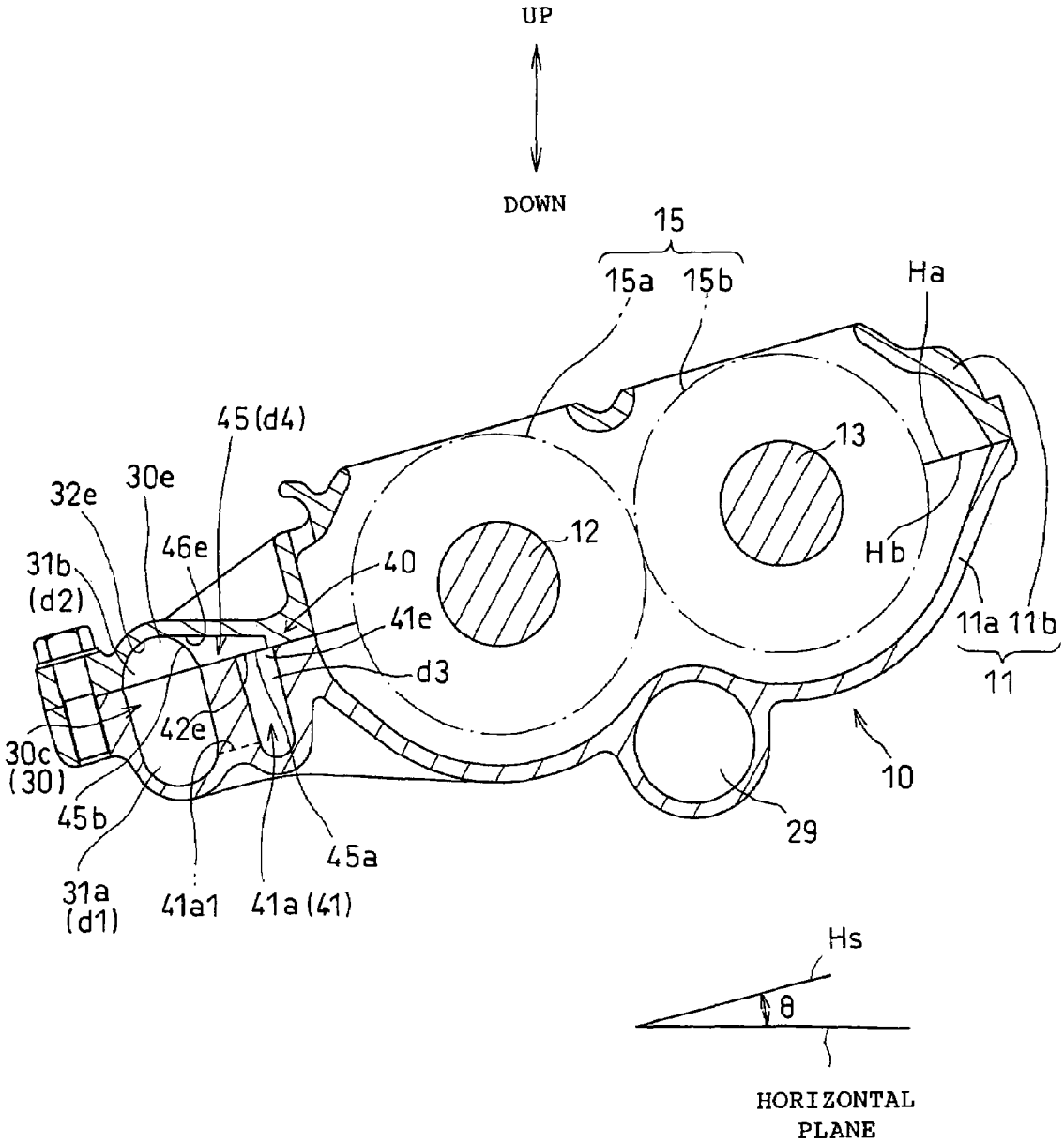
FIG. 3 is a sectional view taken on the line III-III in FIG. 2.

Referring to FIGS. 2 and 3 in combination with FIG. 1, the internal combustion engine E is provided with a balancer 10 for reducing a secondary vibration resulting from the reciprocation of the pistons, and a lubricating system including an positive-displacement oil pump 20 for pumping lubricant oil to moving parts to be lubricated in the internal combustion engine E and to hydraulic mechanisms. The oil pump 20 and the balancer 10 are disposed in a crankcase which is defined by a lower part of the cylinder block 1, the lower block 2 and the oil pan 3 and which holds the crankshaft 4 therein. The oil pump 20 and the balancer 10 are mounted on the lower block 2.

The balancer 10 includes a housing 11 formed by joining a joining surface Ha (FIG. 3) of a lower housing 11*a*, namely, a lower member, and a joining surface Hb (FIG. 3) of an upper housing 11*b*, namely, an upper member, and fastening the lower housing 11*a* and the upper housing 11*b* with bolts, a first balancer shaft 12, a second balancer shaft 13, and balancer weights mounted respectively on the balancer shafts 12 and 13. The balancer shafts 12 and 13 are rotatably supported on the housing 11. The joining surfaces Ha and Hb are contained in a plane inclined at the angle θ to a horizontal plane.

The balancer shafts 12 and 13 are operatively interlocked and are driven by the crankshaft 4. The first balancer shaft 12 is driven for rotation by the crankshaft 4 through a transmission mechanism 14 including a chain 14*a* extended between the crankshaft 4 and the first balancer shaft 12. The second balancer shaft 13 is driven for rotation through a gear train 15 including a drive gear 15*a* mounted on the first balancer shaft 12 and a driven gear 15*b* mounted on the second balancer shaft 13 and engaged with the drive gear 15*a*. The first balancer shaft 12 rotates in the rotating direction of the crankshaft 4, and the second balancer shaft 13 rotates in a rotating direction opposite the rotating direction of the crankshaft 4 at a rotational speed twice as high as that of the crankshaft 4.

Referring to FIG. 1, the lubricating system includes the oil pump 20 rotatively driven by the crankshaft 4 to pump up the lubricant oil contained in the oil pan and to send out the oil, an oil filter 50 provided with a filter element, such as paper filter element, for filtering the oil discharged by the oil pump 20, and oil passages through which the oil flows to the oil filter 50 and the moving parts.

Figure 4:
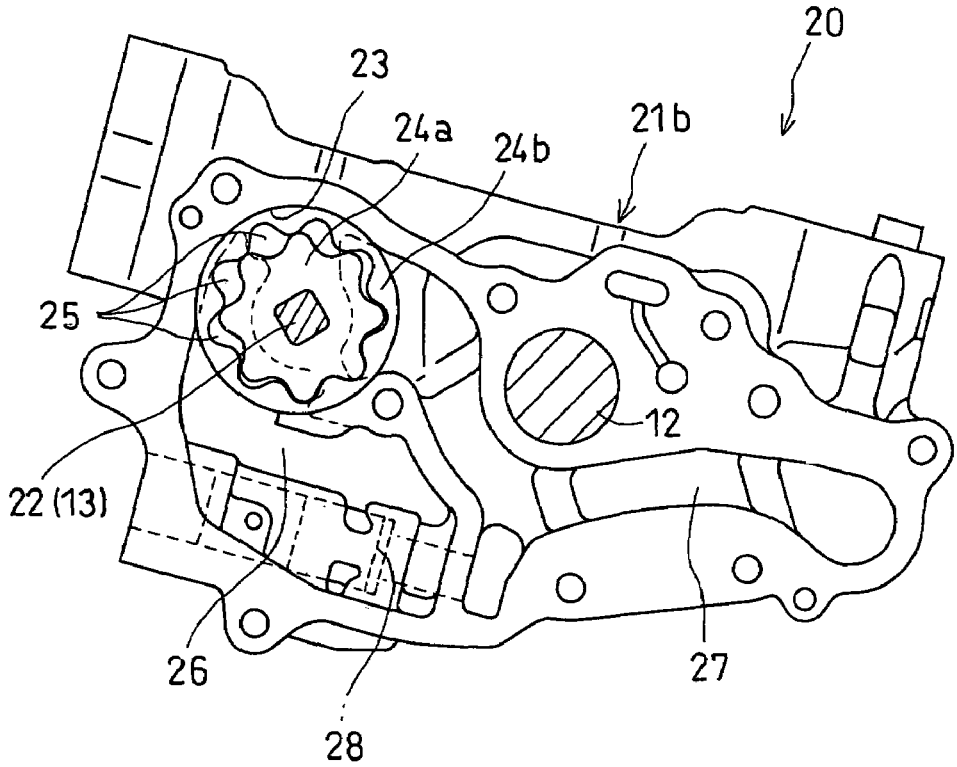
FIG. 4 is a sectional view taken on the line IV-IV in FIG. 2.
Figure 5:
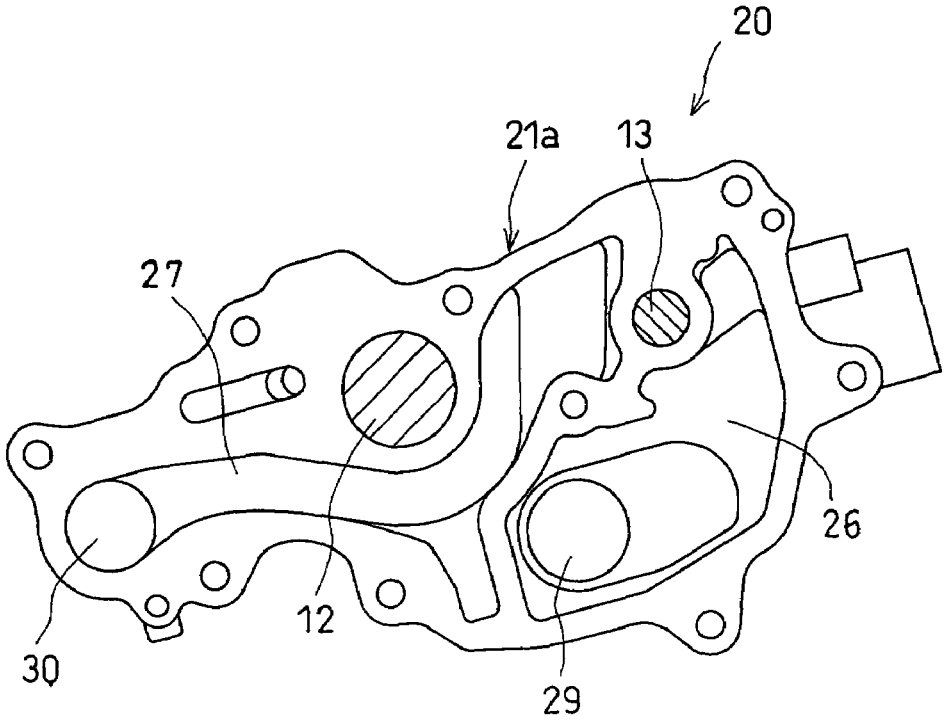
FIG. 5 is a sectional view taken on the line V-V in FIG. 2.

Referring to FIGS. 2, 4 and 5, the oil pump 20, namely, a trochoid oil pump, has a pump housing 21 including a pump body 21*a* formed integrally with the lower housing 11*a* and a pump cover 21*b* fastened to the pump body 21*a* with bolts, a pump shaft 22, which is an end part of the second balancer shaft 13, an inner rotor 24*a* driven by the pump shaft 22 and placed in a chamber 23 formed in the pump cover 21*b*, and an outer rotor 24*b* placed in the chamber 23. The inner rotor 24*a* and the outer rotor 24*b* form a plurality of variable-volume pump chambers 25 in a space defined by the pump body 21*a* and the pump cover 21*b*. The respective volumes of the pump chambers 25 vary according to the rotation of the pump shaft 22.

The pump body 21*a* is provided with a discharge port 27 opening in its joining surface. The pump cover 21*b* is provided with a suction port 26 opening in its joining surface. The oil pump 20 sucks the oil contained in the oil pan 3 through an oil strainer, now shown, and a suction oil passage 29 (see also FIG. 3) formed in the lower housing 11*a* and the suction port 26 into the pump chamber 25 in a suction stroke, and sends the oil by pressure from the pump chamber 25 through the discharge port 27 and a discharge passage 30 formed in the housing 11 to the oil filter 50 in a discharge stroke. The oil filtered by the oil filter 50 flows into the main gallery of the internal combustion engine E and is distributed to the moving parts to be lubricated through oil passages. Some part of the oil is supplied as a working fluid to the hydraulic mechanisms. The oil pump 20 is provided with a pressure-relief valve 28 to prevent the oil pressure at the discharge port 27 from increasing beyond a specified pressure.

The suction oil passage 29 and the suction port 26 form a suction passage connected to the pump chamber 25 to carry the oil to the pump chamber 25. The discharge port 27 and the discharge passage 30 form a discharge passage connected to the pump chamber 25 to carry the oil discharged from the pump chamber 25. The pressure of the oil flowing through the suction passage and that of the oil flowing through the discharge passage are pulsating oil pressures pulsating according to the variation of the respective volumes of the pump chambers 25 resulting from the operation of the pump 20 for sucking and discharging the oil.

Referring to FIGS. 3, 6, 7 and 8, the discharge passage 30 (FIG. 2) horizontally extended in the housing 11, namely, an oil passage forming member, has an upstream section 30*a*, a downstream section 30*b* and a horizontal middle section 30*c* (FIG. 2). The upstream section 30*a* is horizontally extended in the lower housing 11*a* and is connected to the downstream end of the discharge port 27. The downstream section 30*b* is formed in the upper housing 11*b* to carry the oil through oil passages formed in the lower block 2 and the cylinder block 1 (FIG. 1) to the oil filter 50. The horizontal middle section 30*c* extends substantially horizontally between the upstream section 30*a* and the downstream section 30*b*. The horizontal middle section 30*c* is formed along both the respective joining surfaces Ha and Hb of the lower housing 11*a* and the upper housing 11*b*. The horizontal middle section 30*c* has a lower part 31*a*, namely, a groove d1 opening in the joining surface Ha of the lower housing 11*a*, and an upper part 31*b*, namely, a groove d2 opening in the joining surface Hb of the upper housing 11*b*. The upstream section 30*a* and the horizontal middle section 30*c* extend in a substantially horizontal, straight line.

The housing 11 is provided with a pulsating oil pressure reducing device 40 including an oil chamber 41 for reducing the pulsating oil pressure of the oil in the discharge passage 30.

The pulsating oil pressure reducing device 40 includes the horizontally elongate oil chamber 41 connected to the discharge passage 30, and an air vent passage 45 connecting the oil chamber 41 to the discharge passage 30 to discharge air from within the oil chamber 41 into the discharge passage 30.

Figure 7:
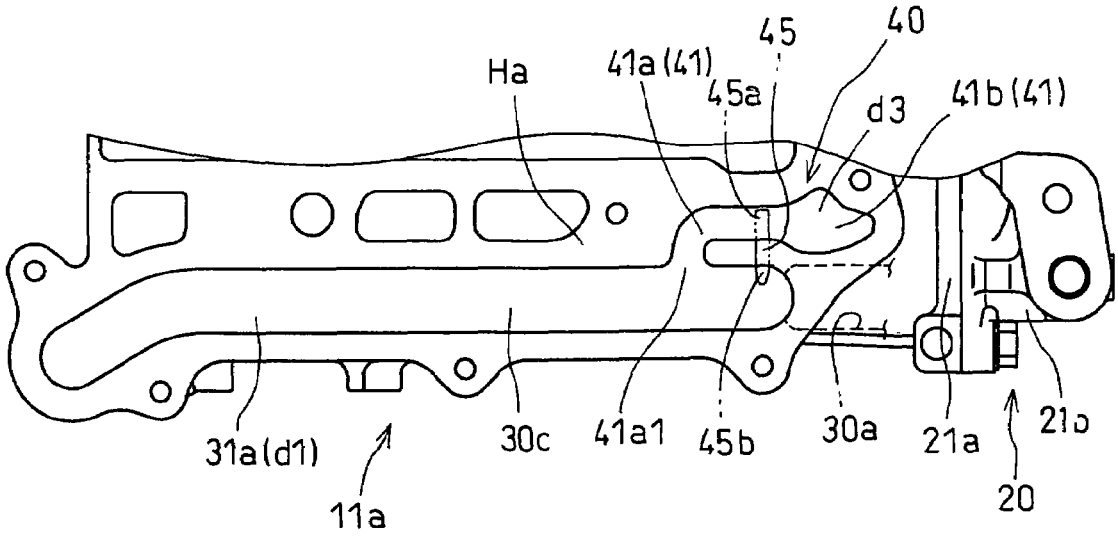
FIG. 7 is a sectional view taken on the line VII-VII in FIG. 6.
Figure 8:
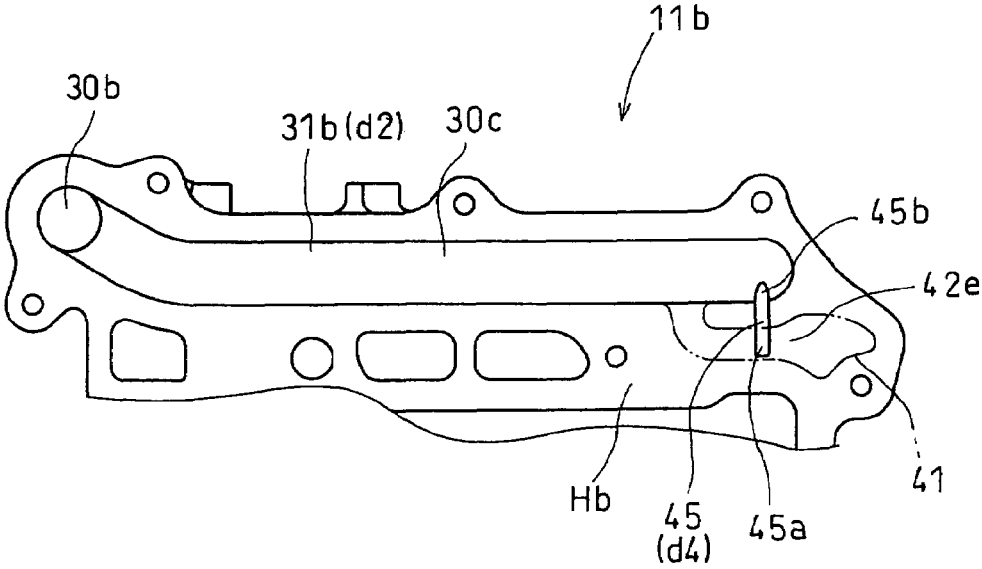
FIG. 8 is a sectional view taken on the line VIII-VIII in FIG. 6.

The oil chamber 41 is a groove d3 opening in the joining surface Ha of the lower housing 11*a* of the housing 11. The oil chamber 41 is placed so as not to overlap, in a vertical direction, the horizontal middle section 30*c* in a horizontal range between a connecting port 41*a*1 and the air vent passage 45. The oil chamber 41, and the upstream section 30*a* and the horizontal middle section 30*c* of the discharge passage 30 intersect a horizontal plane intersecting the connecting port 41*a*1 in a range corresponding to the overall length of the oil chamber 41 with respect to a horizontal direction. Thus the upstream section 30*a* and the horizontal middle section 30*c* of the discharge passage 30, and the oil chamber 41 are arranged substantially parallel to each other in a horizontal direction as shown in FIGS. 2, 3 and 7. The oil chamber 41 and the discharge passage 30 do not overlap each other as viewed vertically.

Referring to FIG. 3, a part of an upper part 41*a* of the oil chamber 41 is at a level above a lower part 31*a* of the discharge passage 30. The upper part 41*a* is a part extending under a ceiling surface 42*e* defining the upper boundary of the oil chamber 41. Air collects in the upper part 41*a* of the oil chamber 41. In this embodiment, the ceiling surface 42*e* is a part of the joining surface Hb and the upper part 41*e* extends horizontally.

The oil chamber 41 has the connecting port 41*a*1 opening into the horizontal middle section 30*c*, a connecting part 41*a* substantially horizontally extending from the discharge passage 30, and an expanded part 41*b* having a sectional area greater than that of the connecting part 41*a*. The oil flows through the connecting port 41*a*1 between the discharge passage 30 and the oil chamber 41. Thus the oil chamber 41 is a closed cavity having the connecting port 41*a*1. For this reason the oil that has flowed through the connecting port 41*a*1 into the oil chamber 41 flows scarcely in the oil chamber 41 and stagnates in the oil chamber 41. Chamber sectional area is the sectional area of an oil passage through which the oil flows into the oil chamber 41.

The pulsating oil pressure in the passage nearer to the oil pump 20 is higher than that in the passage farther from the oil pump 20. To make the oil chamber 41 exhibit its pulsating pressure reducing effect effectively, the connecting port 41*a*1 opens into the horizontal middle section 30*c* at a position close to or near the oil pump 20. The expanded part 41*b* in the depth of the oil chamber 41 is formed in the largest possible volume by using a space in the lower housing 11*a*.

The air vent passage 45 is a slit-like narrow groove d4 formed in the upper housing 11*b* of the housing 11 so as to open in the joining surface Ha. The air vent passage 45 extends at a level higher than the connecting port 41*a*1 as shown in FIG. 3. The air vent passage 45 is formed in such a small sectional area that the flow of the oil into and the flow of the oil out of the oil chamber 41 through the air vent passage 45 do not affect adversely to the pulsating oil pressure reducing effect of the oil chamber 41.

The air vent passage 45 connecting the upper part 41*e* of the oil chamber 41 and the upper part 30*e* of the horizontal middle section 30*c* has an inlet port 45*a* formed at a position between the connecting port 41*a*1 and the expanded part 41*b*, and a discharge port 45*b* opening into the horizontal middle section 30*c* at a level higher than the inlet port 45*a*. The air vent passage 45 communicates with the horizontal middle section 30*c* by way of the discharge port 45*b*. The inlet port 45*a* is formed in the ceiling surface 42*e* so as to open into the upper part 41*e*. The air vent passage 45 extends upward from the inlet port 45*a* formed in the ceiling surface 42*e* as shown in FIG. 3. The inlet port 45*a* does not overlap the horizontal middle section 30*c*, as viewed vertically. The discharge port 45*b* is on the upstream side of the connecting port 41*a*1 with respect to the flowing direction of the oil in the oil passage 30; that is, the discharge port 45*b* is near the oil pump 20.

The upper part 30*e* extends under a ceiling surface defining the upper boundary of the horizontal middle section 30*c*. In this embodiment, the ceiling surface 32*e* is entirely in the upper housing 11*b* and is above the joining surface Ha.

As shown in FIG. 3, a ceiling surface 46*e* covering the air vent passage 45 from above extends so that the ceiling surface 46*e* does not slope downward from the oil chamber 41 toward the horizontal middle section 30*c*; that is, the ceiling surface 46*e* extends at the same height or slopes upward toward the horizontal middle section 30*c*. In this embodiment, the ceiling surface 46*e* slopes upward from the air chamber 41 toward the horizontal middle section 30*c*.

Figure 6:
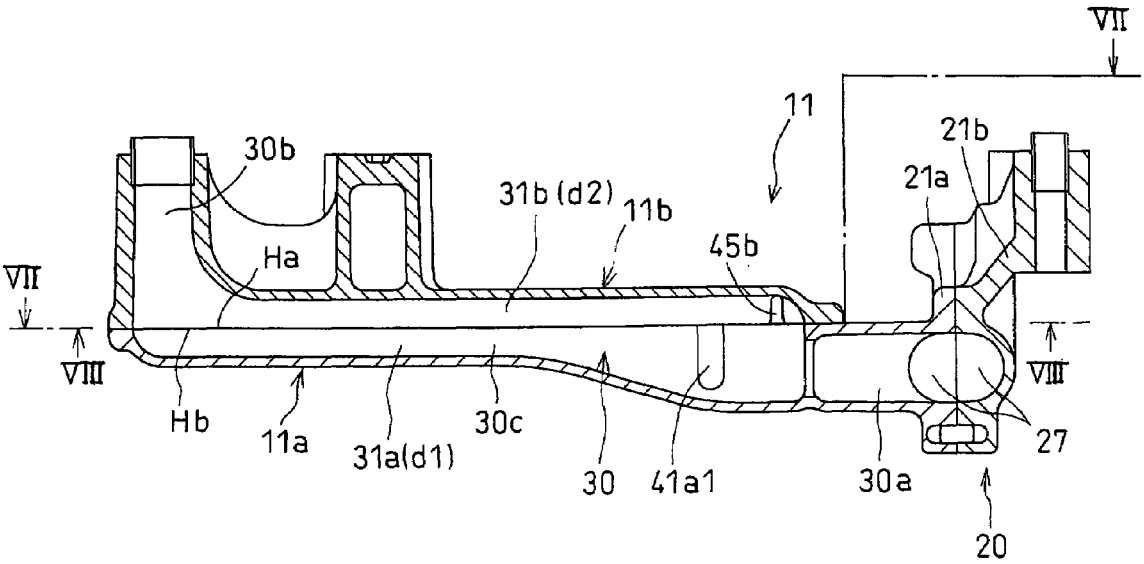
FIG. 6 is a sectional view taken on the line VI-VI in FIG. 2.

The discharge port 45*b* opens into the horizontal middle section 30*c* at a position on the upstream side (FIG. 6) of the connecting port 41*a*1. The air vent passage 45 including the discharge port 45*b* is at a level above the connecting port 41*a*1 in a range corresponding to the horizontal middle section 30*c*, as shown in FIGS. 3 and 6.

The grooves d1 and d2 respectively forming a lower part 31*a* and an upper part 31*b* of the horizontal middle section 30*c*, the groove d4 forming the oil chamber 41, and the narrow groove d4 forming the air vent passage 45 are formed in the lower housing 11*a* and the upper housing 11*b* by drafting in casting the lower housing 11*a* and the upper housing 11*b* in molds. Thus the manufacturing cost can be reduced and the oil chamber 41 and the air vent passage 45 can be easily formed in desired shapes, respectively.

In the pulsating oil pressure reducing device 40, the oil flows from the horizontal middle section 30*c* of the discharge passage 30 through the connecting port 41*a*1 into the oil chamber 41 and fills up the oil chamber 41 while the oil pump 20 is in operation and the oil is flowing through the discharge passage 30. The amplitude of the pulsating oil pressure of the oil in the horizontal middle section 30*c* is reduced while the pulsating oil pressure propagates through the connecting port 41*a*1 to the oil contained in the oil chamber 41. If air is not completely discharged from the oil chamber 41 through the air vent passage 45 and a small amount of air remains in the oil chamber 41, the compression of the air varies according to the pulsating oil pressure and, consequently, the pulsating oil pressure is reduced. The flow of the oil in the oil chamber 41 caused by the flow of a small amount of the oil through the air vent passage 45 between the oil chamber 41 and the horizontal middle section 30*c* provides an additional pulsating oil pressure reducing effect.

Air accumulated in the upper part 41*e* of the oil chamber 41 is discharged through the air vent passage 45 into the discharge passage 30 by the pulsating oil pressure in the horizontal middle section 30*c* acting through the connecting port 41*a*1 on the oil contained in the oil chamber 41. Foreign matters including metal particles accumulated in the oil chamber 41 can be discharged from the oil chamber 41.

Figure 9:
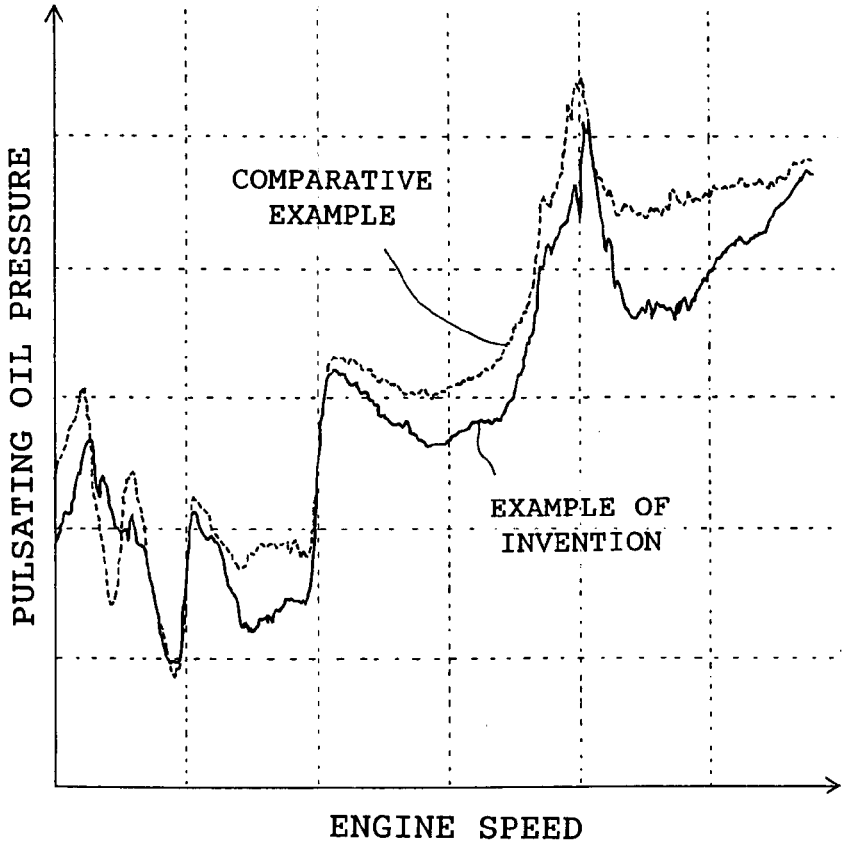
FIG. 9 is a graph comparatively showing variation of pulsating oil pressure with engine speed in a part of an oil passage near an oil filter on an internal engine according to the present invention provided with a pulsating oil pressure reducing device and variation of pulsating oil pressure with engine speed in a part of an oil passage near an oil filter on an internal combustion engine in a comparative example not provided with any pulsating oil pressure reducing device.
Figure 10:
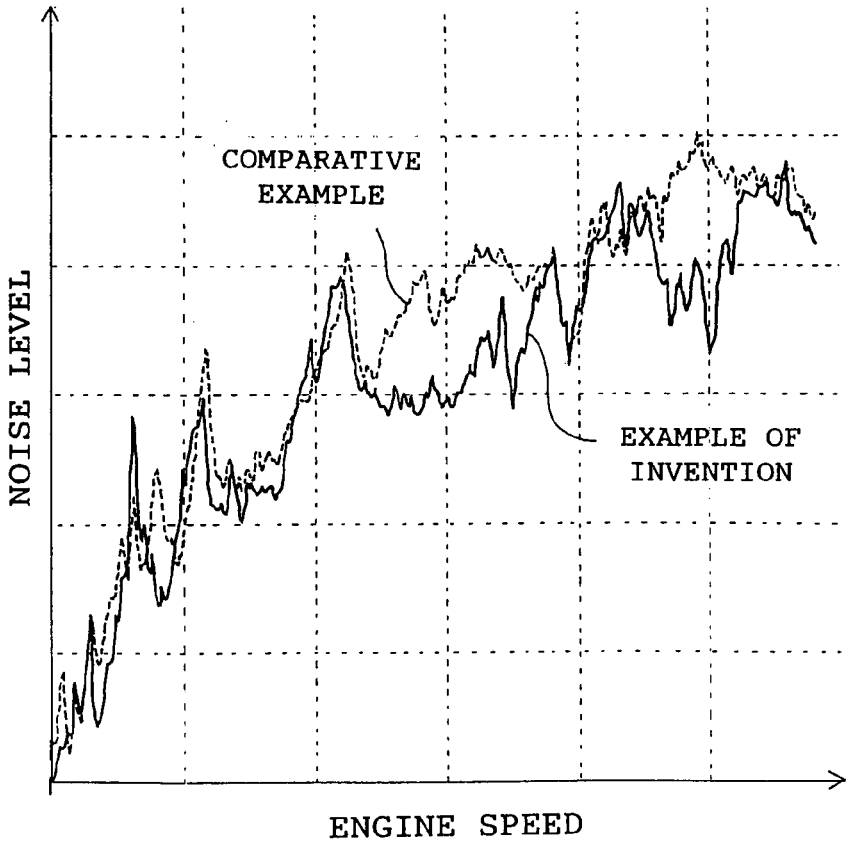
FIG. 10 is a graph comparatively showing variation of noise level of noise generated by an oil filter included in an internal engine according to the present invention provided with a pulsating oil pressure reducing device, with engine speed, and variation of noise level of noise generated by a filter included in an internal combustion engine in a comparative example not provided with any pulsating oil pressure reducing device, with engine speed.

As will be noted from FIG. 9, the pulsating oil pressure in the oil passage near the oil filter 50 on the upstream side of the oil filter 50 in the internal combustion engine E provided with the pulsating oil pressure reducing device 40 placed in the discharge passage 30 extending between the oil pump 20 and the oil filter 50 is low as compared with that in an engine not provided with any device corresponding to the pulsating oil pressure reducing device 40, and consequently noise generated by the filter 50 by the pulsating oil pressure in the former internal combustion engine E is low as compared with that in the latter engine.

The operation and effect of the internal combustion engine E in the preferred embodiment will be described.

The pulsating oil pressure reducing device 40 having the oil chamber 41 for reducing the pulsating oil pressure in the discharge passage 30 in the internal combustion engine E provided with the oil pump 20 has the connecting port 41*a*1 opening into the horizontal middle section 30*c* of the discharge passage 30 and the air vent passage 45 through which air accumulated in the oil chamber 41 is discharged into the discharge passage 30. The air vent passage 45 has the inlet port 45*a* opening into the upper part 31*e* of the horizontal middle section 30*c* and communicates with the upper part 31*e* by way of the discharge port 45*b*. Therefore, air accumulated in the oil chamber 41 is discharged efficiently into the discharge passage 30 to ensure a satisfactory pulsating oil pressure reducing effect. Since the pulsating oil pressure reducing device 40 has the connecting port 41*a*1 and the air vent passage 45 separately, the position of the connecting port 41*a*1 does not place any restrictions to the position of the oil chamber 41 and the air vent passage 45 only needs to meet a condition that the air vent passage 45 is connected to the discharge passage at a position at a level higher than the inlet port 45*a*. Thus air accumulated in the oil chamber 41 can be efficiently discharged and the pulsating oil pressure reducing device 40 has a large degree of freedom of determining the respective positions of the discharge passage 30 and the oil chamber 41.

Thus, air accumulated in the oil chamber 41 can be efficiently discharged into the discharge passage 30 and a satisfactory pulsating oil pressure reducing effect can be ensured even if the discharge passage 30 and the oil chamber 41 are obliged to be horizontally arranged owing to restrictions placed by the position and construction of the housing 11 in which the discharge passage 30 and the oil chamber 41 are formed or by the respective positions of the oil pump 20 and the oil filter 50.

The upstream section 30*a* and the horizontal middle section 30*c* of the discharge passage 30 are horizontal and hence the upper part 41*e* of the oil chamber 41 extends horizontally. Therefore, air accumulates in the oil chamber 41 more easily than in a vertically extending oil chamber. However, air accumulated in the oil chamber 41 can be efficiently discharged through the air vent passage 45 to ensure a satisfactory pulsating oil pressure reducing effect.

The height of the ceiling surface 46*e* of the air vent passage 45 with respect to a vertical direction increases with distance from the oil chamber 41 toward the horizontal middle section 30*c* of the discharge passage 30. Therefore, air can easily move toward the discharge passage 30 in the oil chamber 41 and hence air can be discharged at a high efficiency from the oil chamber 41.

The discharge passage 30 and the pulsating oil pressure reducing device 40 are formed in the housing 11 formed by joining the respective joining surfaces Ha and Hb of the lower housing 11*a* and the upper housing 11*b*, the discharge passage 30 extends along both the lower housing 11*a* and the upper housing 11*b*, the oil chamber 41 is formed only in the lower housing 41*a*, and the air vent passage 45 is formed only in the upper housing 11*b*. Therefore, the air vent passage 45 having the inlet port 45*a* opening in the ceiling surface of the oil chamber 41 and connected to the discharge passage 30 can be easily formed in relation to the discharge passage 30 and the oil chamber 41. Since the connecting port 41*a*1 is formed only in the lower housing 11*a*, the air vent passage 45 including the discharge port 45*b* can be formed at a level above the connecting port 41*a*1 by simple construction, and air discharged through the air vent passage 45 cannot easily return through the connecting port into the oil chamber. Since the air vent passage 45 is formed only in the upper housing 11*b*, the upper housing 11*b* does need to be replaced with another one even if the angle θ of inclination of the internal combustion engine E to a horizontal plane is changed and only the lower housing 11*b* is replaced with another lower housing provided with an air vent passage formed so as to meet a condition corresponding to the inclination of the internal combustion engine E. Thus the pulsating oil pressure reducing device 40 has high applicability to various positions of the internal combustion engine E, and the pulsating oil pressure reducing device 40 can reduce the cost of the internal combustion engine E.

Since the pulsating oil pressure reducing device 40 has the air vent passage 45, the flow of the oil in the oil chamber 41 caused by the flow of a small amount of the oil through the air vent passage 45 between the oil chamber 41 and the horizontal middle section 30*c* provides an additional pulsating oil pressure reducing effect.

Possible modifications of the foregoing embodiment will be described.

The entire discharge passage 30 may be formed by joining the grooves d1 and d2.

The oil chamber 41 may be replaced with a plurality of individual oil chambers or may be connected to the suction passage.

The pulsating oil pressure in the oil passage included in the pulsating oil pressure reducing device 40 may be generated by a device other than the oil pump, such as a valve that opens and closes the oil passage.

Although the internal combustion engine in this embodiment has been described on an assumption that the internal combustion engine is mounted on a vehicle, the internal combustion engine may be an engine included in a marine propulsion device, such as an outboard motor provided with a vertical crankshaft.

The machine provided with the pulsating oil pressure reducing device 40 may be a prime mover other than the internal combustion engine or may be a machine other than the prime mover.

What is claimed is:

1. A machine provided with a pulsating oil pressure reducing device, for reducing pulsating oil pressure in an oil passage, including an oil chamber communicating with the oil passage by way of a connecting port in a manner to make oil stagnate in the oil chamber;

wherein the oil chamber is connected to the oil passage by an air vent passage through which air is discharged from the oil chamber into the oil passage, the air vent passage is provided separately from the connecting port and has an inlet port opening into a top part of the oil chamber and an outlet port opening into the oil passage at a level above the inlet port.

2. The machine according to claim 1, wherein the oil passage and the oil chamber are horizontally arranged in side-by-side relation.

3. The machine according to claim 2, wherein the oil passage and the oil chamber extend horizontally.

4. The machine according to claim 1, wherein the air vent passage has an upper ceiling surface sloping upward from the oil chamber toward the oil passage.

5. The machine according to claim 1, wherein the oil passage and the pulsating oil pressure reducing device are formed in a structure dividable along a parting line into an upper member and a lower member, the oil passage is defined by both the upper and the lower member, the oil chamber is formed only in the lower member, and the air vent passage is formed only in the upper member.

6. The machine according to claim 5, wherein the oil chamber has a groove formed in the lower member and is a cavity having an expanded part in a depth thereof remote from the connecting port opening into the oil passage.

7. The machine according to claim 6, wherein the inlet port of the air vent passage is positioned nearer to the connecting port than the expanded part of the oil chamber.

8. The machine according to claim 5, wherein the air vent passage is a narrow groove formed in the upper member.

9. The machine according to claim 1, wherein the oil passage has an upstream end connected to an oil pump, and the outlet port of the air vent passage is nearer to the oil pump than the connecting port.

* * * * *